US007673761B2

(12) United States Patent
Lee et al.

(10) Patent No.: US 7,673,761 B2
(45) Date of Patent: Mar. 9, 2010

(54) WINE REFRIGERATOR WITH SHELF HAVING ELASTIC SUPPORT MEMBERS

(75) Inventors: Dong-Hoon Lee, Incheon (KR); Tae-Hee Lee, Seoul (KR); Young-Hoon Yun, Daegu (KR); Yong-Gu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/123,358

(22) Filed: May 19, 2008

(65) Prior Publication Data

US 2008/0217270 A1 Sep. 11, 2008

Related U.S. Application Data

(62) Division of application No. 11/013,427, filed on Dec. 17, 2004, now Pat. No. 7,377,397.

(30) Foreign Application Priority Data

May 18, 2004 (KR) ..... 35354/2004

(51) Int. Cl.
*A47F 5/00* (2006.01)

(52) U.S. Cl. ..... 211/183; 211/85.22; 211/74

(58) Field of Classification Search ..... 211/85.22, 211/134, 59.2, 90.03, 153, 181.1, 74, 41.4, 211/41.9, 41.8, 106, 133.5, 183, 133.2, 126.9; 248/249; D6/566; 312/116, 410, 408; 108/180, 108/163; 24/460, 462

See application file for complete search history.

(56) References Cited

U.S. PATENT DOCUMENTS 2,018,002 A 10/1935 Avery
2,066,335 A * 1/1937 Comstock ..... 211/123
2,230,975 A 2/1941 Gratz
2,417,123 A * 3/1947 Philipp ..... 62/414
2,620,254 A 12/1952 Beckett
2,776,756 A 1/1957 Allan
3,371,796 A * 3/1968 Crouch ..... 211/74
3,669,520 A * 6/1972 Jansen ..... 312/351
3,991,856 A 11/1976 Shigeta et al.
4,174,486 A * 11/1979 Winkler ..... 312/321.5
4,282,977 A 8/1981 Di Lorenzo
4,294,363 A * 10/1981 Oztekin et al. ..... 211/59.2
4,391,377 A 7/1983 Ziaylek, Jr.
4,416,380 A * 11/1983 Flum ..... 211/59.2
4,890,746 A * 1/1990 Trulaske, Sr. ..... 211/59.2
5,403,464 A 4/1995 Mayer et al.
5,450,971 A * 9/1995 Boron et al. ..... 211/134
5,645,182 A * 7/1997 Miller et al. ..... 211/134

(Continued)

FOREIGN PATENT DOCUMENTS

DE 74 07 337 U 6/1974

(Continued)

*Primary Examiner*—Jennifer E. Novosad
(74) *Attorney, Agent, or Firm*—Birch, Stewart, Kolasch & Birch, LLP

(57) ABSTRACT

A shelf of a wine refrigerator includes a frame disposed in a horizontal direction inside a chill room. A plurality of support wires extend in the forward and backward directions of the frame at predetermined intervals in the right and left directions of the frame. A plurality of elastic support members inserted onto each support wire elastically support items, such as wine bottles.

11 Claims, 8 Drawing Sheets

U.S. PATENT DOCUMENTS

| | | | | |
|---|---|---|---|---|
| 5,697,302 | A | 12/1997 | Putnam | |
| 5,862,923 | A * | 1/1999 | Nordquist et al. | 211/59.2 |
| 6,056,381 | A | 5/2000 | Turner | |
| 6,328,170 | B1 * | 12/2001 | Lee | 211/59.2 |
| D475,374 | S | 6/2003 | Segers | |
| 6,672,464 | B2 * | 1/2004 | Robertson | 211/59.2 |
| 7,237,856 | B2 * | 7/2007 | Bienick et al. | 312/408 |
| 7,377,397 | B2 * | 5/2008 | Lee et al. | 211/134 |
| 2002/0066708 | A1 * | 6/2002 | Gerard | 211/74 |

FOREIGN PATENT DOCUMENTS

| | | | |
|---|---|---|---|
| DE | 198 21 342 | A1 | 11/1999 |
| GB | 2 189 387 | A | 11/1987 |
| KR | 10-0324518 | B1 | 2/2002 |

* cited by examiner

WINE REFRIGERATOR WITH SHELF HAVING ELASTIC SUPPORT MEMBERS

This application is a Divisional of application Ser. No. 11/013,427, filed on Dec. 17, 2004 now U.S. Pat. No. 7,377,397, which claims priority on Korean Application No. 10-2004-0035354 filed May 18, 2004 under 35 U.S.C. § 119, the entire contents of which are hereby incorporated by reference.

BACKGROUND OF THE INVENTION

1. Field of the Invention

The present invention relates to a shelf of a wine refrigerator, and more particularly to, a shelf of a wine refrigerator which can stably support wine bottles stored in a chill room without vibrations.

2. Description of the Background Art

In general, since wine is being ripened in a bottle, wine requires careful handling and storage. Maintenance of proper sunlight, humidity and temperature and interception of vibrations are known as very important factors deciding quality of wine.

FIG. 1 is a perspective view illustrating a conventional wine refrigerator, and FIG. 2 is a plane view illustrating a shelf of FIG. 1.

Referring to FIGS. 1 and 2, the conventional wine refrigerator 10 includes a main body 11 having a chill room 13 inside, and a door 17 coupled to the side of the main body 11, for opening or closing the chill room 13.

A temperature control unit 15 is disposed at the upper portion of the main body 11, for controlling a temperature of the chill room 13.

Shelf support units 14 are fixedly formed on both sidewalls of the chill room 13, and shelves 21 for supporting wine bottles 50 are slidably installed on the shelf support units 14.

The structure of the shelf 21 will now be explained with reference to FIG. 2. A plurality of support wires 25 are installed inside a frame 23 at predetermined intervals in the width direction of the frame 23, namely the right and left directions when seen from the drawing.

The support wires 25 are coupled inside the frame 23 in the forward and backward directions of the frame 23, for supporting the wine bottles 50.

In the conventional shelf 21 of the wine refrigerator 10, the wine bottles 50 are directly put on the support wires 25, not on special vibration isolation members. Accordingly vibrations generated by a compressor in the operation of the wine refrigerator 10 are transmitted directly to the wine bottles 50 through the shelf 21, to make inside substances of wine float. As a result, quality of wine is reduced.

SUMMARY OF THE INVENTION

Therefore, an object of the present invention is to provide a shelf of a wine refrigerator which can improve quality of wine by preventing vibrations generated by a compressor of the wine refrigerator from being transmitted to wine bottles stored in a chill room.

To achieve these and other advantages and in accordance with the purpose of the present invention, as embodied and broadly described herein, there is provided a shelf of a wine refrigerator, including: a frame disposed inside a chill room in the horizontal direction; a plurality of support wires formed long inside the frame in the forward and backward directions of the frame at predetermined intervals in the right and left directions of the frame; and a plurality of elastic support members inserted onto each support wire, for elastically supporting wine bottles.

Preferably, each of the elastic support members includes first and second support units having the same width as that of each support wire. Here, the first support units are disposed at the rear portion of the frame, for supporting the lower portion of the wine bottle, and the second support units are disposed at the middle portion of the frame, for supporting the middle portion of the wine bottle.

According to another aspect of the present invention, a shelf of a wine refrigerator includes: a frame disposed inside a chill room in the horizontal direction; a plurality of support wires formed long inside the frame in the forward and backward directions of the frame at predetermined intervals in the right and left directions of the frame; and a plurality of elastic support members coupled to each support wire, for supporting wine bottles.

Preferably, each of the elastic support members includes first and second support units having the same diameter as that of each support wire, and third support units having a relatively larger diameter than the first and second support units.

Preferably, the first support units are disposed at the rear portion of the frame, for supporting the lower portion of the wine bottle, and the second and third support units are disposed at the middle portion of the frame, for supporting the middle portion of the wine bottle. In the case that the wine bottle has a small diameter, the third support units support a neck unit of the wine bottle.

According to yet another aspect of the present invention, a shelf of a wine refrigerator includes: a frame disposed inside a chill room in the horizontal direction; a plurality of support wires formed long inside the frame in the right and left directions of the frame at predetermined intervals in the forward and backward directions of the frame; and a plurality of elastic support members coupled to each support wire, for elastically supporting wine bottles.

Preferably, each of the elastic support members includes first and second support units having the same diameter as that of each support wire, and third support units having a relatively larger diameter than the first and second support units.

Preferably, the first support units are disposed at the rear portion of the frame, for supporting the lower portion of the wine bottle, and the second and third support units are disposed at the middle portion of the frame, for supporting the middle portion of the wine bottle. In the case that the wine bottle has a small diameter, the third support units support a neck unit of the wine bottle.

According to yet another aspect of the present invention, a shelf of a wine refrigerator includes: a frame disposed inside a chill room in the horizontal direction; a plurality of support wires formed long inside the frame in the forward and backward directions of the frame at predetermined intervals in the right and left directions of the frame; and a plurality of elastic support members slidably coupled to each support wire, for elastically supporting wine bottles.

Preferably, each of the elastic support members includes a plurality of coupling units inserted onto each support wire, and a connecting unit for connecting the coupling units adjacent to each other in the right and left directions among the plurality of coupling units.

Preferably, the connecting units are arranged in the orthogonal direction to each support wire, namely in the right and left directions of the frame, and the coupling units are formed to slide in the length direction of the support wires, so that the whole elastic members can slide in the forward and backward directions of the frame.

According to yet another aspect of the present invention, a shelf of a wine refrigerator includes: a frame disposed inside a chill room in the horizontal direction; a first support wire fixed to the rear portion of the frame; a second support wire detachably installed at the front portion of the frame; and a plurality of elastic support members inserted onto the outer circumferential surfaces of the first and second support wires, for elastically supporting wine bottles.

Preferably, a plurality of fixing grooves into which the ends of the second support wire are inserted are formed on both top surfaces of the frame at regular intervals in the forward and backward directions of the frame.

Preferably, the second support wire is inserted into each fixing groove, so that an interval between the first support wire and the second support wire can be adjusted.

Preferably, a plurality of drop preventing wires for preventing drop of the wine bottles are arranged inside the frame at smaller intervals than the diameter of the wine bottles.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
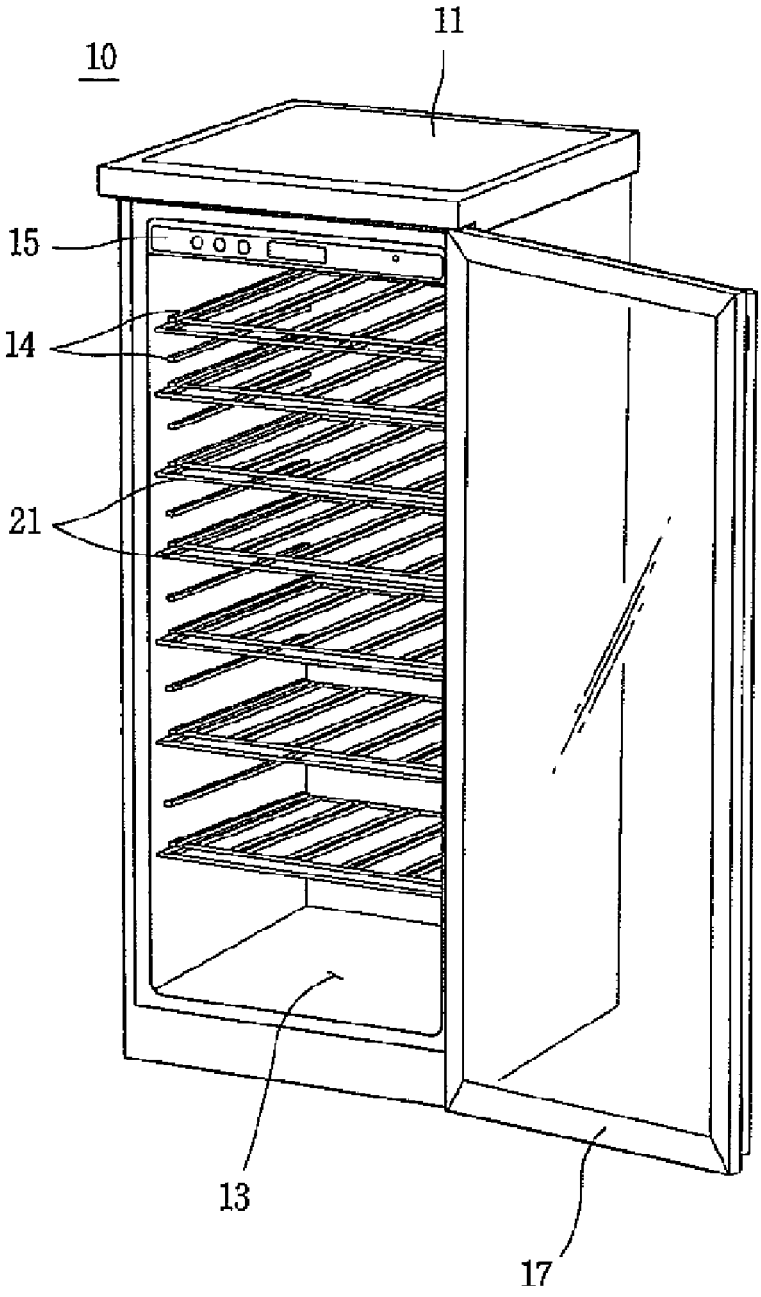
FIG. 1 CONVENTIONAL ART
FIG. 1 is a perspective view illustrating a conventional wine refrigerator.
Figure 2:
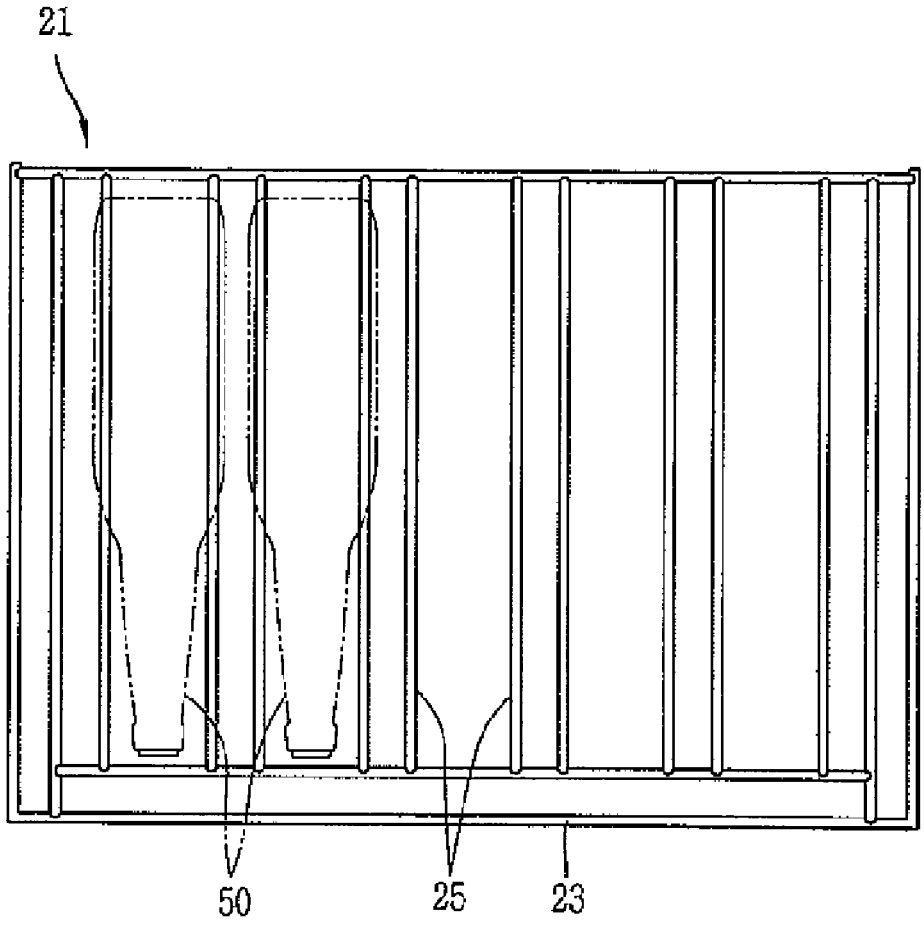
FIG. 2 CONVENTIONAL ART
FIG. 2 is a plane view illustrating a shelf of FIG. 1.

A structure of a wine refrigerator in accordance with the present invention is identical to that of the conventional wine refrigerator of FIG. 1 except for a shelf, and thus explanations thereof are omitted.

Figure 3:
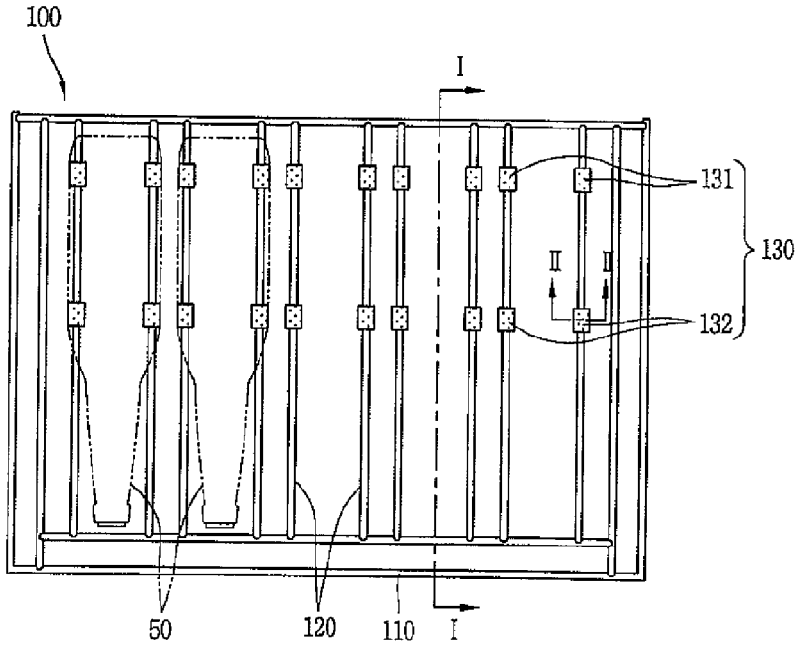
FIG. 3 is a plane view illustrating a shelf of a wine refrigerator in accordance with a first embodiment of the present invention.
Figure 4:
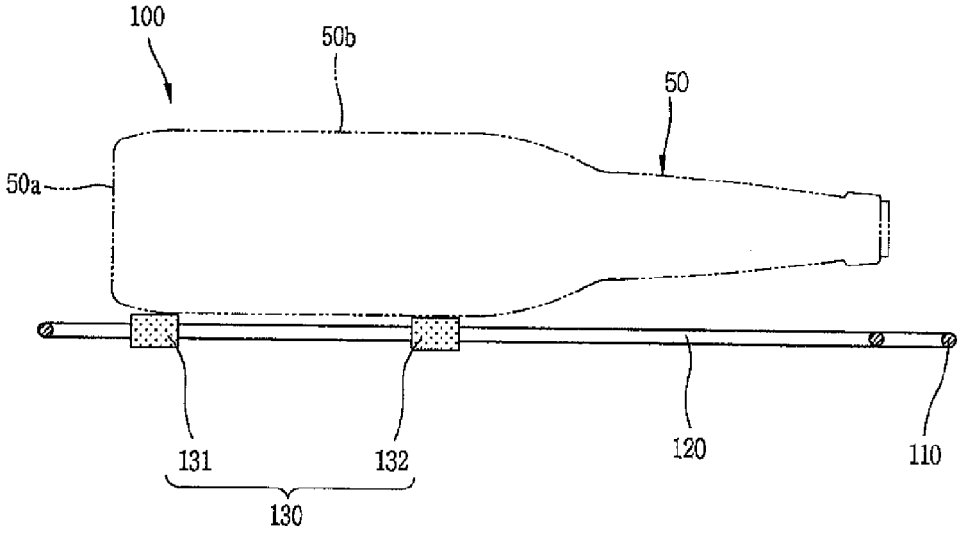
FIG. 4 is a cross-sectional view taken along line I-I of FIG. 3.
Figure 5:
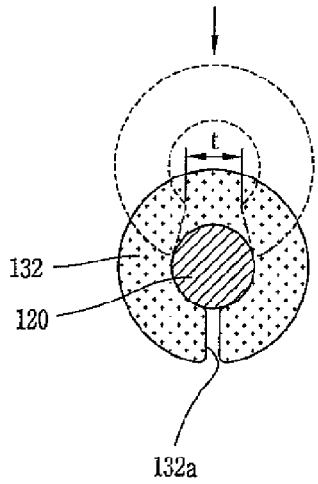
FIG. 5 is a cross-sectional view taken along line II-II of FIG. 3.

FIG. 3 is a plane view illustrating a shelf of a wine refrigerator in accordance with a first embodiment of the present invention, FIG. 4 is a cross-sectional view taken along line I-I of FIG. 3, and FIG. 5 is a cross-sectional view taken along line II-II of FIG. 3.

As illustrated in FIGS. 3 to 5, the shelf 100 of the wine refrigerator in accordance with the first embodiment of the present invention includes a frame 110 disposed inside a chill room 13 in the horizontal direction, a plurality of support wires 120 formed long inside the frame 110 in the forward and backward directions of the frame 110 at predetermined intervals in the right and left directions of the frame 110, and a plurality of elastic support members 130 inserted onto each support wire 120, for elastically supporting wine bottles 50.

Each of the support wires 120 can be manufactured by using a different material from that of the frame 110 and fixed to the frame 110 by using a general fixing means such as welding, or incorporated with the frame 110 according to casting or pressing by using the same material as that of the frame 110.

Each of the elastic support members 130 includes first and second support units 131 and 132 having the same width as that of each support wire 120. Here, the first support units 131 are disposed at the rear portion of the frame 110, for supporting the lower portion 50*a* of the wine bottle 50, and the second support units 132 are disposed at the middle portion of the frame 110, for supporting the middle portion 50*b* of the wine bottle 50.

The lower portions of the second support units 132 are cut to form cutting grooves 132*a*. As indicated by a wavy line of FIG. 5, when the second support unit 132 is pressed in the down direction, the lower portion of the second support unit 132 is elastically transformed and opened, and the support wire 120 is inserted through the widened gap t. At the same time, as indicated by a solid line of FIG. 5, the lower portion of the second support unit 132 returns to the original position. Since the cutting groove 132*a* is formed at the lower portion of the second support unit 132, the second support unit 132 can be easily inserted onto the support wire 120, and easily disconnected from the support wire 120 in replacement of the support wire 120.

The operation of the shelf of the wine refrigerator in accordance with the first embodiment of the present invention will now be described.

When the wine bottle 50 is put on the top surface of the elastic support member 130, the wine bottle 50 does not contact the support wires 120 but the elastic support member 130. Since the elastic support member 130 is made of a soft elastic material such as rubber, the elastic support member 130 restricts or absorbs external vibrations generated by a compressor in the operation of the wine refrigerator, thereby preventing the vibrations from being transmitted to the wine bottle 50. As a result, quality of wine is improved.

Figure 6:
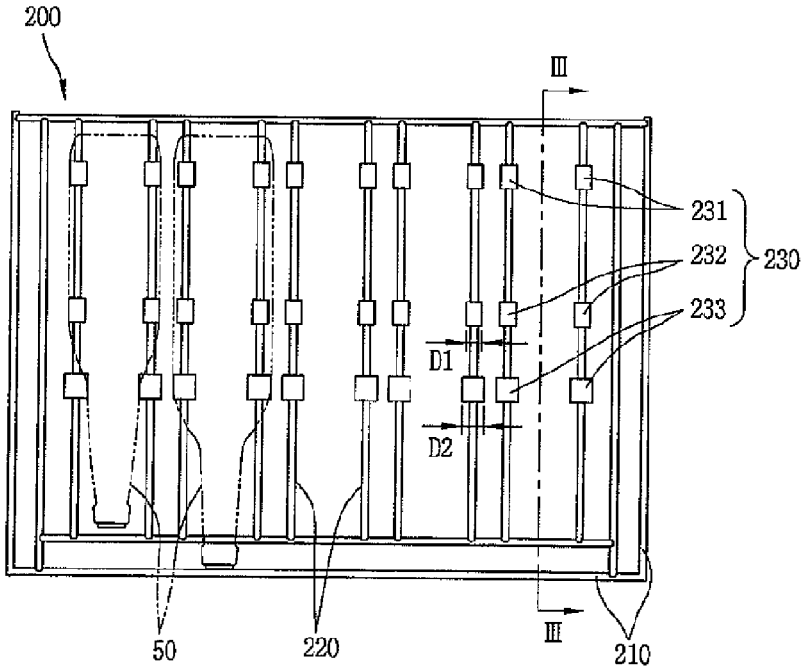
FIG. 6 is a plane view illustrating a shelf of a wine refrigerator in accordance with a second embodiment of the present invention.
Figure 7:
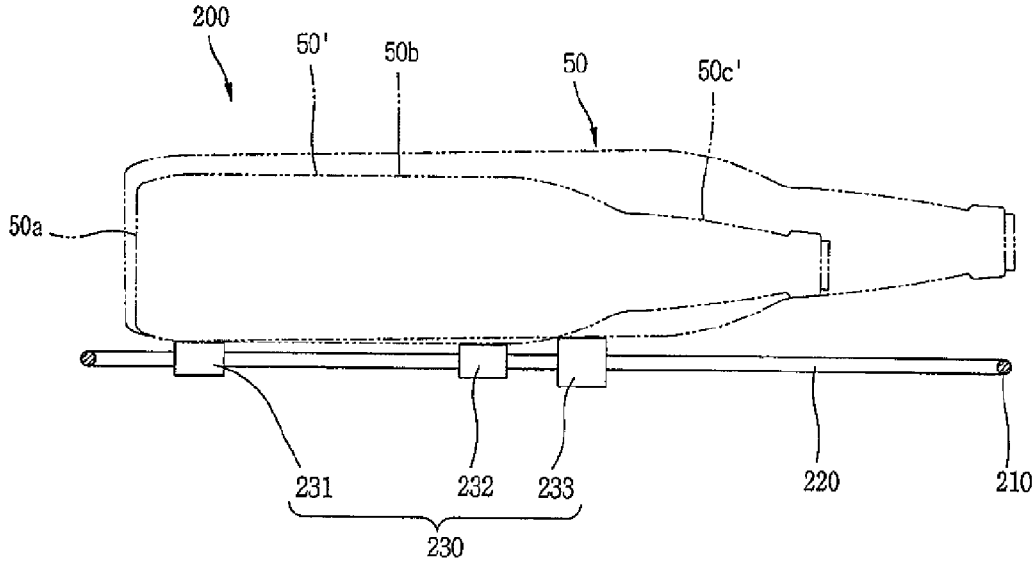
FIG. 7 is a cross-sectional view taken along line III-III of FIG. 6.

FIG. 6 is a plane view illustrating a shelf of a wine refrigerator in accordance with a second embodiment of the present invention, and FIG. 7 is a cross-sectional view taken along line III-III of FIG. 6.

As shown in FIGS. 6 and 7, the shelf 200 of the wine refrigerator in accordance with the second embodiment of the present invention includes a frame 210 disposed inside a chill room 13 in the horizontal direction, a plurality of support wires 220 formed long inside the frame 210 in the forward and backward directions of the frame 210 at predetermined intervals in the right and left directions of the frame 210, and a plurality of elastic support members 230 coupled to each support wire 220, for supporting wine bottles 50.

Each of the elastic support members 230 includes first and second support units 231 and 232 having the same diameter D1 as that of each support wire 220, and third support units 233 having a relatively larger diameter D2 than the first and second support units 231 and 232.

The first support units 231 are disposed at the rear portion of the frame 210, for supporting the lower portion 50*a* of the wine bottle 50, and the second and third support units 232 and 233 are disposed at the middle portion of the frame 210, for supporting the middle portion 50*b* of the wine bottle 50. In the case that the wine bottle 50' has a small diameter, the third support units 233 support a neck unit 50*c*' of the wine bottle 50'.

As compared with the shelf 100 of the first embodiment, the shelf 200 of the second embodiment includes the third support units 233 for closely supporting the middle portions 50*b* or the neck units 50'*c* of the wine bottles 50 or 50'. Accordingly, the shelf 200 efficiently prevents flow of the wine bottles 50 and 50' and stably maintains various sizes of wine bottles 50 and 50' without tilt.

Figure 8:
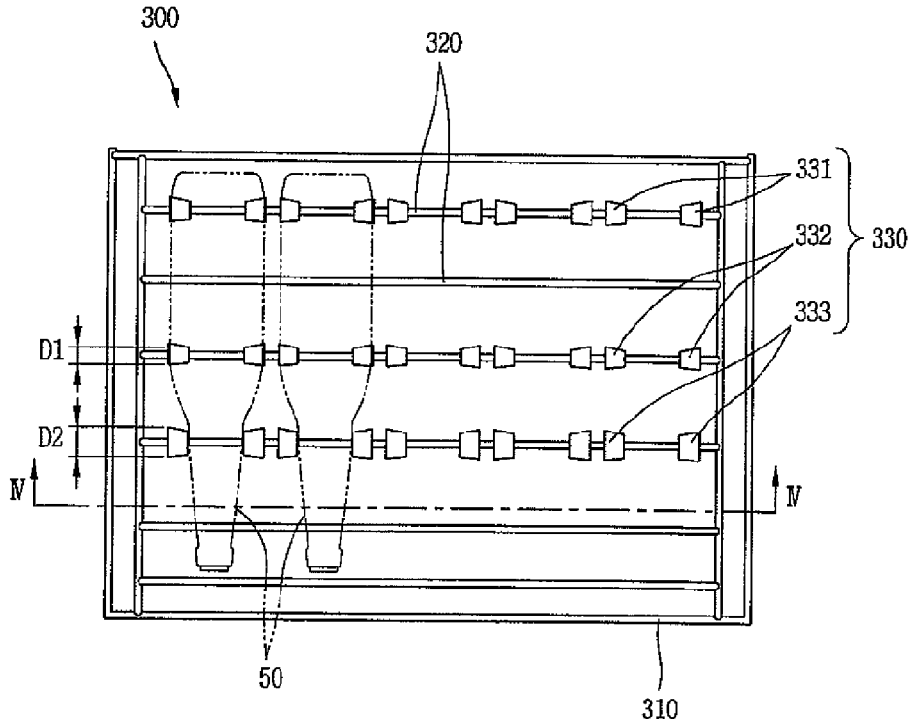
FIG. 8 is a plane view illustrating a shelf of a wine refrigerator in accordance with a third embodiment of the present invention.
Figure 9:
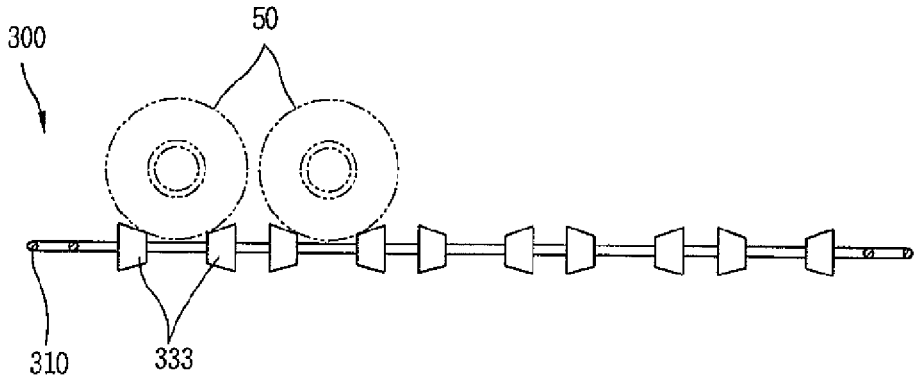
FIG. 9 is a cross-sectional view taken along line IV-IV of FIG. 8.

FIG. 8 is a plane view illustrating a shelf of a wine refrigerator in accordance with a third embodiment of the present invention, and FIG. 9 is a cross-sectional view taken along line IV-IV of FIG. 8.

Referring to FIGS. 8 and 9, the shelf 300 of the wine refrigerator in accordance with the third embodiment of the present invention includes a frame 310 disposed inside a chill room 13 in the horizontal direction, a plurality of support wires 320 formed long inside the frame 310 in the right and left directions of the frame 310 at predetermined intervals in the forward and backward directions of the frame 310, and a plurality of elastic support members 330 coupled to each support wire 320, for elastically supporting wine bottles 50.

Each of the elastic support members 330 includes first and second support units 331 and 332 having the same diameter D1 as that of each support wire 320, and third support units 333 having a relatively larger diameter D2 than the first and second support units 333.

The first support units 331 are disposed at the rear portion of the frame 310, for supporting the lower portion of the wine bottle 50, the second support units 332 are disposed at the middle portion of the frame 50, for supporting the middle portion of the wine bottle 50, and the third support units 333 support a neck unit of the wine bottle having a small diameter.

As compared with the shelf 200 of the second embodiment, in the shelf 300 of the third embodiment, the first to third support units 331 to 333 are formed in a truncated conical shape, so that the outer circumferential surfaces of the first to third support units 331 to 333 can be inclined to correspond to the outer circumferential surfaces of the wine bottles 50. Since the outer circumferential surfaces of the first to third support units 331 to 333 are inclined to correspond to the outer circumferential surfaces of the wine bottles 50, vibrations of the wine bottles 50 can be efficiently prevented.

In addition, the support wires 320 are formed long inside the frame 310 in the right and left directions of the frame 310 at predetermined intervals in the forward and backward directions of the frame 310. As the support wires 320 are formed long in the right and left directions of the frame 310, intervals between the third support units 333 inserted onto the support wires 320 are controlled so that the outer circumferential surfaces of the third support units 333 can be closely adhered to the outer circumferential surfaces of the wine bottles 50. As a result, vibrations of the wine bottles 50 are efficiently prevented.

Figure 10:
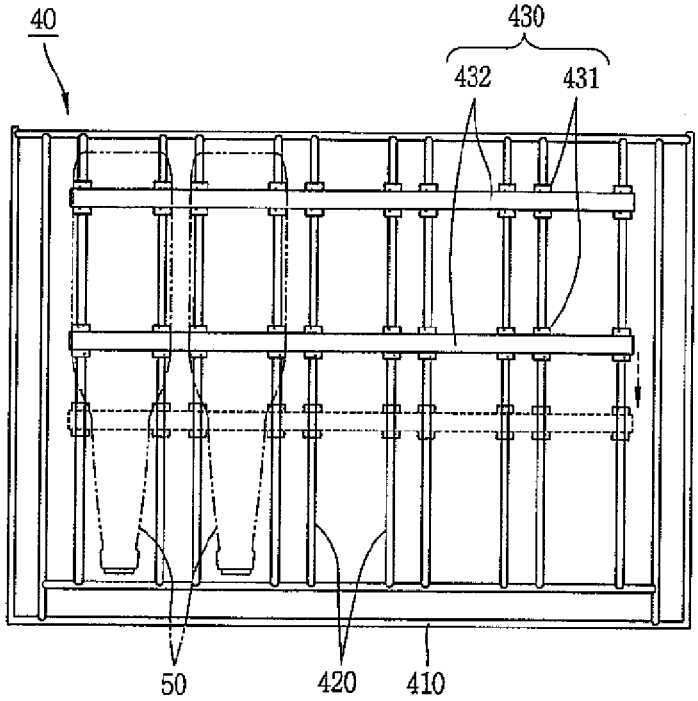
FIG. 10 is a plane view illustrating a shelf of a wine refrigerator in accordance with a fourth embodiment of the present invention.
Figure 11:
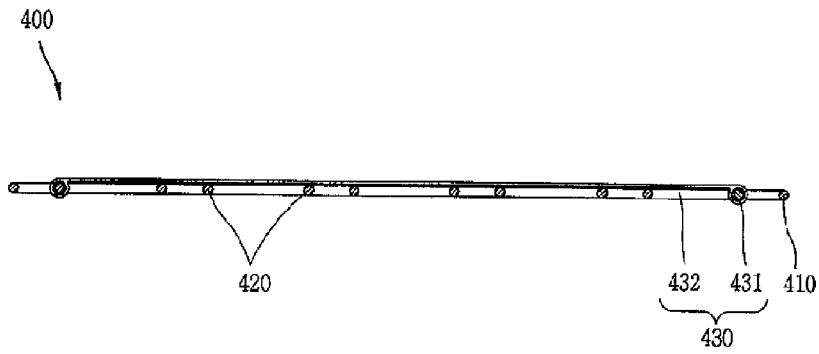
FIG. 11 is a cross-sectional view taken along line V-V of FIG. 10.

FIG. 10 is a plane view illustrating a shelf of a wine refrigerator in accordance with a fourth embodiment of the present invention, and FIG. 11 is a cross-sectional view taken along line V-V of FIG. 10.

As illustrated in FIGS. 10 and 11, the shelf 400 of the wine refrigerator in accordance with the fourth embodiment of the present invention includes a frame 410 disposed inside a chill room 13 in the horizontal direction, a plurality of support wires 420 formed long inside the frame 410 in the forward and backward directions of the frame 410 at predetermined intervals in the right and left directions of the frame 410, and a plurality of elastic support members 430 slidably coupled to each support wire 420, for elastically supporting wine bottles 50.

Each of the elastic support members 430 includes a plurality of coupling units 431 inserted onto each support wire 420, and a connecting unit 432 for connecting the coupling units 431 adjacent to each other in the right and left directions among the plurality of coupling units 431.

The connecting units 432 are arranged in the orthogonal direction to each support wire 420, namely in the right and left directions of the frame 410, and the coupling units 431 are formed to slide in the length directions of the support wires 420, so that the whole elastic members 430 can slide in the forward and backward directions of the frame 410. Preferably, the connecting units 432 are made of rubber, for elastically supporting the wine bottles 50.

The operation of the shelf of the wine refrigerator in accordance with the fourth embodiment of the present invention will now be described.

As compared with the shelf 100 of the first embodiment, the shelf 400 of the fourth embodiment includes the connecting units 432 and controls intervals between the connecting units 432 at the same time. In addition, the connecting units 432 are arranged in the right and left directions of the frame 410, for supporting a few wine bottles 50 at the same time.

Figure 12:
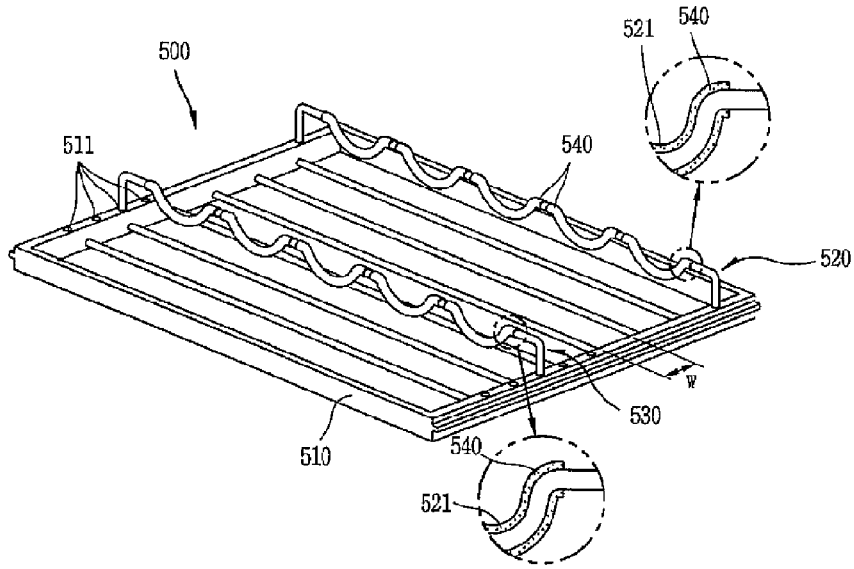
FIG. 12 is a perspective view illustrating a shelf of a wine refrigerator in accordance with a fifth embodiment of the present invention.
Figure 13:
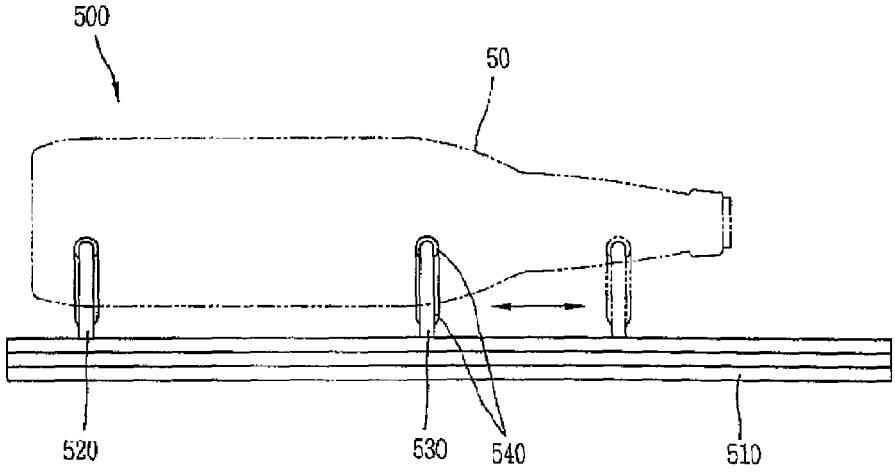
FIG. 13 is a side view illustrating the shelf of the wine refrigerator of FIG. 12.

FIG. 12 is a perspective view illustrating a shelf of a wine refrigerator in accordance with a fifth embodiment of the present invention, and FIG. 13 is a side view illustrating the shelf of the wine refrigerator of FIG. 12.

As depicted in FIGS. 12 and 13, the shelf 500 of the wine refrigerator in accordance with the fifth embodiment of the present invention includes a frame 510 disposed inside a chill room 13 in the horizontal direction, a first support wire 520 fixed to the rear portion of the frame 510, a second support wire 530 detachably installed at the front portion of the frame 510, and a plurality of elastic support members 540 inserted onto the outer circumferential surfaces of the first and second support wires 520 and 530, for elastically supporting wine bottles 50.

A plurality of fixing grooves 511 into which the ends of the second support wire 530 are inserted are formed on both top surfaces of the frame 510 at regular intervals in the forward and backward directions of the frame 510.

The second support wire 530 is inserted into each fixing groove 511, so that an interval between the first support wire 520 and the second support wire 530 can be adjusted.

A plurality of housing units 521 for housing the outer circumferential surface of the wine bottle 50 are regularly formed in a U shape on the first and second support wires 520. The elastic support members 540 are inserted onto the outer circumferential surfaces of the housing units 521.

In addition, a plurality of drop preventing wires 550 for preventing drop of the wine bottles 50 are arranged inside the frame 510 at smaller intervals than the diameter of the wine bottles 50.

The operation of the shelf of the wine refrigerator in accordance with the fifth embodiment of the present invention will now be described.

When the wine bottle 50 is put on the top surface of the elastic support member 540, the wine bottle 50 does not contact the support wires 520 and 530 but the elastic support member 540. Since the housing units 521 are formed in a U shape to surround the outer circumferential surface of the wine bottle 50 and the elastic support member 540 is made of a soft elastic material such as rubber, the elastic support member 540 restricts or absorbs external vibrations generated by a compressor in the operation of the wine refrigerator, thereby preventing the vibrations from being transmitted to the wine bottle 50. As a result, quality of wine is improved.

Even if the wine bottle 50 slides from the elastic support member 540 due to careless handling of the user, the plurality of preventing wires 550 arranged at smaller intervals than the diameter of the wine bottle 50 efficiently prevent drop and breakage of the wine bottle 50.

Figure 14:
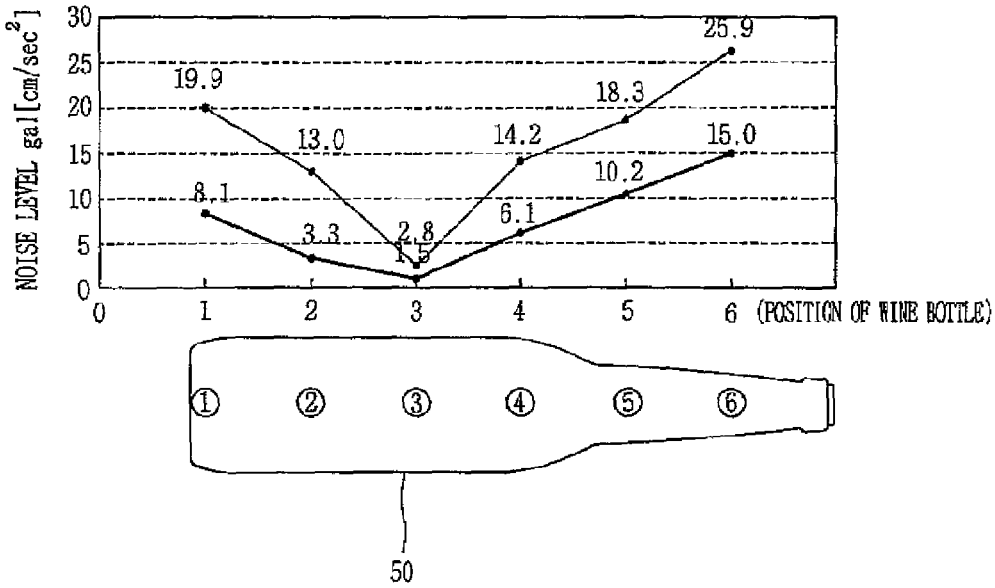
FIG. 14 is a graph showing vibration levels according to positions of a wine bottle on the conventional shelf of the wine refrigerator and the shelf of the wine refrigerator in accordance with the present invention.

FIG. 14 is a graph showing vibration levels according to positions of the wine bottle on the conventional shelf of the wine refrigerator and the shelf of the wine refrigerator in accordance with the present invention.

In the graph, the transverse axis shows positions of the wine bottle, and the ordinates axis shows vibration levels.

As shown in FIG. 14, when the vibration levels transmitted to the wine bottle 50 are measured, the vibrations increase from the center portion 3 of the wine bottle 50 to the lower portion and the neck unit of the wine bottle 50.

As compared with the graph L1 of the conventional shelf, the graph L2 of the shelf of the present invention shows relatively low vibration levels.

As discussed earlier, in accordance with the present invention, the shelf of the wine refrigerator prevents vibrations generated by the compressor of the wine refrigerator from being transmitted to the wine bottles stored in the chill room, by elastically supporting the wine bottles regardless of sizes by sliding the elastic materials such as rubber. Therefore, the shelf of the wine refrigerator improves quality of wine and prevents drop and breakage of the wine bottles.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator, the refrigerator having a main body having a chill room, a door coupled to a side of the main body for opening or closing the chill room, and a shelf located inside of the chill room, the shelf comprising:

a frame disposed inside of the chill room of the refrigerator in the horizontal direction;

a plurality of support wires extending inside the frame in the forward and backward directions of the frame at predetermined intervals in the right and left directions of the frame;

a first elastic support member slidably inserted onto a support wire, the first elastic support having an inner surface engaging the support wire and an outer surface spaced from the inner surface by a first thickness; and a second elastic support member slidably inserted onto the support wire, the second elastic support having an inner surface engaging the support wire and an outer surface spaced from the inner surface by a second thickness, wherein the first and second elastic support members are not identical as the first and second elastic support members have different thicknesses.

2. The refrigerator of claim 1, wherein the two support members are made of rubber.

3. The refrigerator of claim 1, wherein the two support members have a longitudinal slit through which the support wire can be inserted into the support units.

4. The refrigerator of claim 1, wherein the two support units comprise vibration restricting members.

5. The refrigerator of claim 1, wherein the at least two support members comprise vibration isolating members.

6. The refrigerator of claim 1, wherein the first and second support members are spaced from one another, the second support member closer to a front of the shelf.

7. The refrigerator of claim 6, wherein the second support member has a thickness greater than the first support member.

8. The refrigerator of claim 1, further comprising a third support member, the third support member being located on the shelf between the first and second support members.

9. The refrigerator of claim 8, wherein the third support member has a thickness equal to the thickness of the first support member.

10. The refrigerator of claim 1, wherein the second support member has a thickness greater than the first support member.

11. A refrigerator, the refrigerator having a main body having a chill room, a door coupled to a side of the main body for opening or closing the chill room, and a shelf located inside of the chill room, the shelf comprising:

a frame disposed inside of the chill room of the refrigerator in the horizontal direction;

a plurality of support wires extending inside the frame in the forward and backward directions of the frame at predetermined intervals in the right and left directions of the frame; a first elastic support member slidably inserted onto a support wire, the first elastic support having an inner surface engaging the support wire and an outer surface spaced from the inner surface by a first thickness; and a second elastic support member slidably inserted onto the support wire, the second elastic support having an inner surface engaging the support wire and an outer surface spaced from the inner surface by a second thickness, wherein the first and second elastic support members have different thicknesses, and wherein the outer surfaces of the first and second support members are smooth, arcuate surfaces.

* * * * *